US008096341B2

(12) United States Patent
Teunissen

(10) Patent No.: US 8,096,341 B2
(45) Date of Patent: Jan. 17, 2012

(54) ACTUATING SYSTEM AND FOLDING PANEL ASSEMBLY

(75) Inventor: Sander Teunissen, Rotterdam (NL)

(73) Assignee: Hunter Douglas Industries BV, EI Rotterdam (NL)

( * ) Notice: Subject to any disclaimer, the term of this patent is extended or adjusted under 35 U.S.C. 154(b) by 190 days.

(21) Appl. No.: 12/352,662

(22) Filed: Jan. 13, 2009

(65) Prior Publication Data

US 2009/0178770 A1 Jul. 16, 2009

(30) Foreign Application Priority Data

Jan. 14, 2008 (EP) ..... 08000556

(51) Int. Cl.
*E05D 15/26* (2006.01)

(52) U.S. Cl. ..... 160/199; 160/206

(58) Field of Classification Search ..... 160/199, 160/206, 198, 203, 204, 188, 189
See application file for complete search history.

(56) References Cited

U.S. PATENT DOCUMENTS

| | | | | | |
|---|---|---|---|---|---|
| 2,614,627 | A * | 10/1952 | Miller | 160/199 |
| 3,181,596 | A * | 5/1965 | Winnan et al. | 160/206 |
| 3,275,064 | A * | 9/1966 | Hansen | 160/206 |
| 3,314,534 | A * | 4/1967 | Winnan | 206/325 |
| 3,342,246 | A * | 9/1967 | Reiss | 160/195 |
| 3,605,853 | A * | 9/1971 | Osborn | 160/229.1 |
| 4,269,254 | A * | 5/1981 | Horton | 160/206 |
| 4,276,919 | A * | 7/1981 | Walters | 160/206 |
| 4,427,049 | A * | 1/1984 | Belanger et al. | 160/199 |
| 4,852,628 | A * | 8/1989 | Klein | 160/199 |
| 4,957,600 | A * | 9/1990 | Carlson et al. | 160/199 |
| 5,143,137 | A * | 9/1992 | West | 160/199 |
| 6,098,695 | A * | 8/2000 | Schwingle | 160/199 |
| 6,470,952 | B1 * | 10/2002 | Cline et al. | 160/188 |

FOREIGN PATENT DOCUMENTS

| | | |
|---|---|---|
| DE | 24 55 658 A1 | 8/1976 |
| FR | 1 293 576 A | 5/1962 |

* cited by examiner

*Primary Examiner* — David Purol
(74) *Attorney, Agent, or Firm* — Dorsey & Whitney LLP

(57) ABSTRACT

A folding panel assembly includes at least first and second, substantially rectangular panels, the first panel having first and second vertical ends, and the second panel having third and fourth vertical ends, the second and third vertical ends being hinged to one another about a hinge axis parallel thereto. An actuating system includes a substantially horizontal track, with a first pivot support for connection to the first panel, a carriage traversable along the track, with a second pivot support for connection to the second panel. The actuating system further includes a flexible drive element arranged parallel to the track and engaging the carriage for traversing it along the track. The actuating system employs an elongated connecting rod with a first longitudinal end pivotally connected to the carriage and a second, opposite longitudinal end pivotally connected to the first panel at a location adjacent to the second vertical end thereof. A line including the first and second longitudinal ends of the elongated connecting rod, in use, is excluded from becoming aligned with respect to the first panel in any position of the carriage along the track.

13 Claims, 5 Drawing Sheets

ACTUATING SYSTEM AND FOLDING PANEL ASSEMBLY

CROSS REFERENCE TO RELATED APPLICATION

This application claims priority to European patent application No. 08000556.4, filed 14 Jan. 2008, and such application is hereby incorporated by reference as if fully disclosed herein.

BACKGROUND OF THE INVENTION

1. Field of the Invention

The invention relates to an actuating system for a folding panel assembly and to a folding panel assembly incorporating same.

2. Description of the Relevant Art

Folding panel assemblies, such as folding doors, using an actuating system for operating and guiding its movement are known. One typical folding panel assembly is described in U.S. Pat. No. 6,470,952 and includes at least first and second, substantially rectangular panels, the first panel having first and second vertical ends, and the second panel having third and fourth vertical ends, the second and third vertical ends being hinged to one another about a hinge axis parallel thereto. An actuating system includes a substantially horizontal track, with a first pivot support for connection to the first panel, a carriage traversable along the track, with a second pivot support for connection to the second panel. The actuating system further includes a flexible drive element arranged parallel to the track and in engagement with the carriage for traversing same along the track. When closed the panels of such panel assemblies are aligned in a coplanar position, while traversing of the flexible drive element is in parallel to a plane incorporating the coplanar panels. Without any specific measures the panels would resist folding about the hinge connection between the second and third vertical ends. The solution proposed by U.S. Pat. No. 6,470,952 includes a cam roller riding in a cam slot and initiating a pivotal bias to the second panel in response to the carriage being moved from or towards the position of closure. While this arrangement has generally provided a satisfactory operation and guiding for folding panel assemblies, its necessarily compact dimensions have caused it to be susceptible to contamination and malfunction in applications on the exterior of building structures.

BRIEF SUMMARY OF THE INVENTION

Accordingly it is an object of the present invention to propose an improved actuating system for a folding panel assembly that is less susceptible to contamination, but which can still be unobtrusively incorporated in the actuating system. In a more general sense it is thus an object of the invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end the invention provides an actuating system for a folding panel assembly, with the folding panel assembly including at least first and second, substantially rectangular panels, the first panel having first and second vertical ends, and the second panel having third and fourth vertical ends, the second and third vertical ends being hinged to one another about a hinge axis parallel thereto, the actuating system including a substantially horizontal track, having a first pivot support for connection to the first panel; a carriage traversable along the track, having a second pivot support for connection to the second panel; and a flexible drive element arranged parallel to the track and in engagement with the carriage for traversing same along the track, wherein an elongated connecting rod has a first longitudinal end pivotally connected to the carriage and a second, opposite longitudinal end pivotally connectable to the first panel at a location adjacent to the second vertical end thereof and wherein a line through the first and second longitudinal ends of the elongated connecting rod, in use, is excluded from becoming aligned with respect to the first panel in any position of the carriage along the track. By providing the elongate connecting rod between a pivot point on the carriage and by preventing it from becoming longitudinally aligned with the first panel, a force component becomes available that initiates opening of the hinged joint between the first and second panels. Conversely there is also a force component during closing, which urges the panels into coplanar alignment. This arrangement is also less susceptible to contamination or to malfunction as a result of wear.

According to a further aspect of the actuating system according to the invention the flexible drive element can be looped around at least a first pulley wheel, located in a vicinity of a longitudinal end of the track. This enables to subject opposite ends of the flexible drive element to a pulling action, to move same in opposite directions, from one and the same longitudinal end of the track. It is further advantageous for the, or a further pulley wheel to be rotationally drivable for traversing the carriage. In such a case the pulley wheel may be drivable connected to an electric motor.

The invention also provides a folding panel assembly including the subject actuating system and at least first and second, substantially rectangular panels, the first panel having first and second vertical ends, and the second panel having third and fourth vertical ends, the second and third vertical ends being hinged to one another about a hinge axis parallel thereto, the first panel being connected to the first pivot support, the second pivot support being connected to the second panel and wherein the first panel is pivotally connected to the second longitudinal end of the elongated connecting rod. Rather than merely offering the actuating system as an after-market improvement modification for existing panel assemblies, full benefit of the invention may be obtained when the design of the actuating system can be incorporated into the design of a panel assembly. In this regard such a folding panel assembly may be further improved if the first and second panels are made to equal width and/or if the first and second panels are suspended from the track being arranged in an overhead position. In addition the folding panel assembly may then further include a bottom rail for guiding the first and second panels at a lower end thereof.

BRIEF DESCRIPTION OF THE DRAWINGS

The invention will now be described in reference to the accompanying drawings, in which.

DESCRIPTION OF THE PREFERRED EMBODIMENTS

Figure 1:
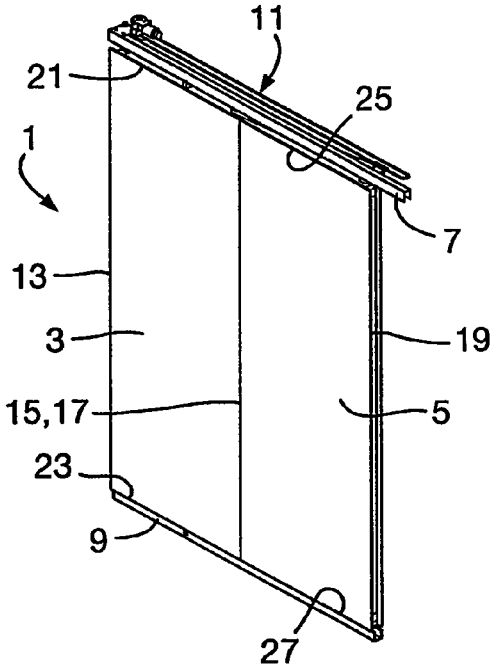
FIG. 1 shows a folding panel assembly, employing the actuating system according to the invention, in a closed position.
Figure 2:
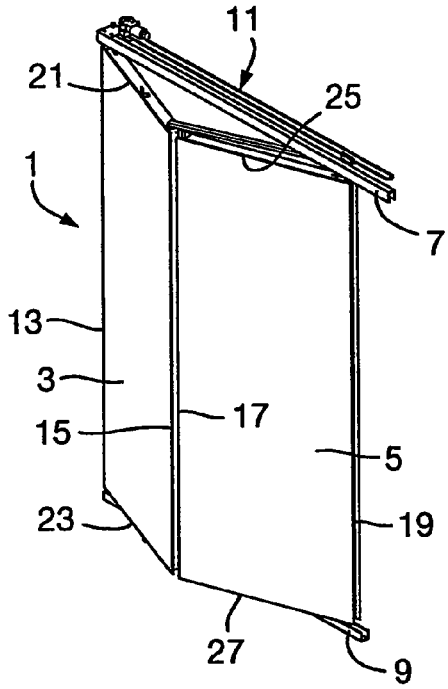
FIG. 2 shows the folding panel assembly of FIG. 1 in a first intermediate position between open and closed positions.
Figure 3:
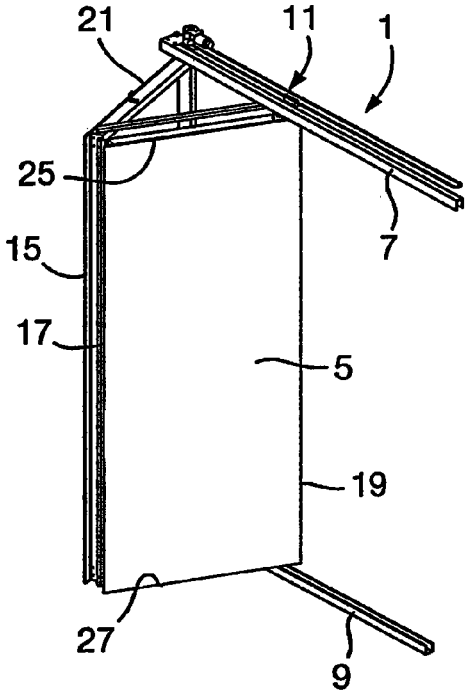
FIG. 3 shows the folding panel assembly of FIG. 1 in a second intermediate position between open and closed positions.
Figure 4:
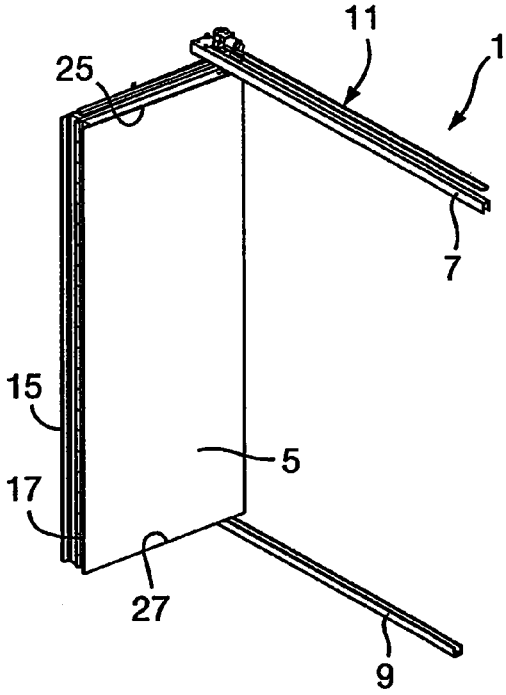
FIG. 4 shows the folding panel assembly of FIG. 1 in its fully open position.

Referring to FIG. 1 the folding panel assembly 1 has a first substantially rectangular panel 3 and a second similarly rectangular panel 5. The first and second panels 3, 5 are suspended from an overhead track 7 in a manner to be described herein below. At a lower end the first and second panels 3, 5 can be guided by an optional bottom rail 9. The track 7 forms part of an actuating system, generally referenced as "11", which actuating system will be described in reference to FIGS. 5 to 8.

The first panel 3 has a first vertical end 13 and a second vertical end 15. The second panel 5 has a third vertical end 17 and a fourth vertical end 19. The first and second vertical ends 13, 15 of the first panel 3 are joined by an upper horizontal end 21 and a lower horizontal end 23. Similarly, the third and fourth vertical ends 17, 19 of the second panel 5 are joined by an upper horizontal end 25 and a lower horizontal end 27.

The actuating system 11 as shown in FIGS. 5 to 8 has a looped driving belt 31 with a return pulley 33 at one longitudinal end, defining two parallel branches of the flexible drive belt 31, and an electric driving motor 35 at an opposite longitudinal end. The flexible drive element 31 extends parallel to the track 7 and a carriage 37 traversably carried and guided by the track through a shoe 39 is attached to one of the branches of the looped driving belt 31 extends along the track 7 at a slight distance determined by a first extension 41 of track 7, supporting the return pulley 33 and a second extension 43 carrying the drive motor 35. The carriage 37 has an extension arm 45 which carries an engagement member 47 which engages the flexible drive element 31. The engagement member 47 is provided with a first pivot 49 which pivotally receives a first longitudinal end of a connection rod 51. The connecting rod 51 extends to a second pivot 53 by which it is pivotally connected to the first panel 3 in a location adjacent to the second vertical end 15. The second vertical end 15 of the first panel 3 is hingedly connected to the third vertical end of the second panel 5 by a hinge formation 55. The hinge formation 55 can be formed by a so called piano hinge but also by any other suitable form of hinge. A particularly suitable alternative form of hinge may be formed by virtual hinge arrangements such as those proposed by FR 1 293 576 or DE 2455 658.

The hinge axis, whether physical or virtual, is best positioned adjacent to the side of the panels facing the actuating system 11 as this will enable a close joint between the vertical ends 15, 17 of the first and second panel 3, 5 on a side thereof substantially hiding the actuating system 11.

Figure 5:
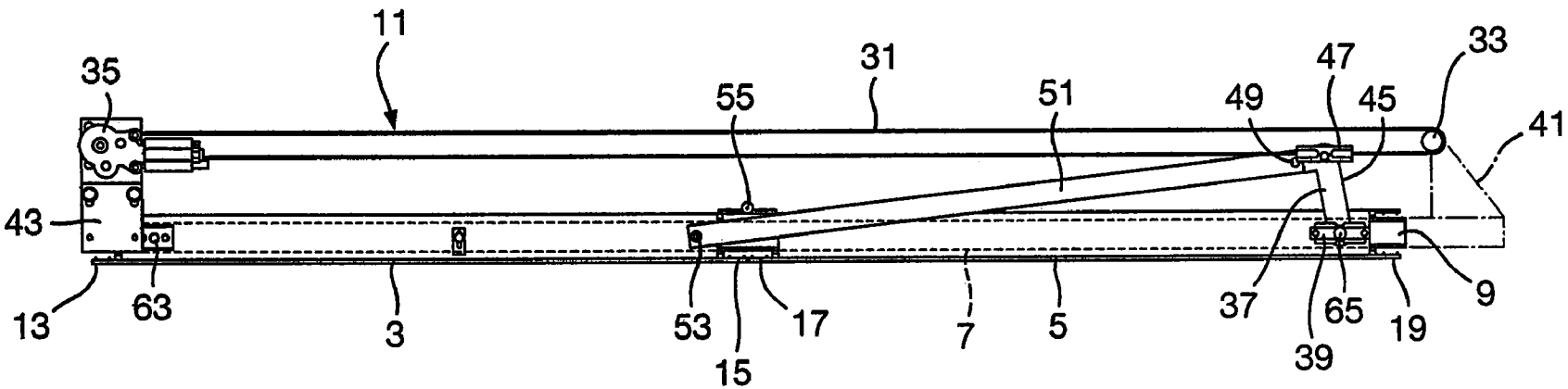
FIG. 5 shows a top plan view of the folding panel assembly in the position of FIG. 1.

It is further seen in FIG. 5 that a longitudinal centre line of the connecting rod 51, which includes the first and second pivots 49, 51 extends at an acute angle with respect to the track 7 and the common plane in which the first and second panel 3, 5 are in a closed position. To break the coplanar position of the first and second panels 3, 5 when these are in a closed position, it will be necessary to initiate a force component perpendicular to the movement of the carriage 37 during opening of the panels. To this end the connecting rod 51 is provided and is arranged so that it remains at an included angle with the track 7, which in any position of the carriage 37 along the track 7 excludes the connecting rod 51 from becoming aligned with respect to the first panel 3.

Figure 6:
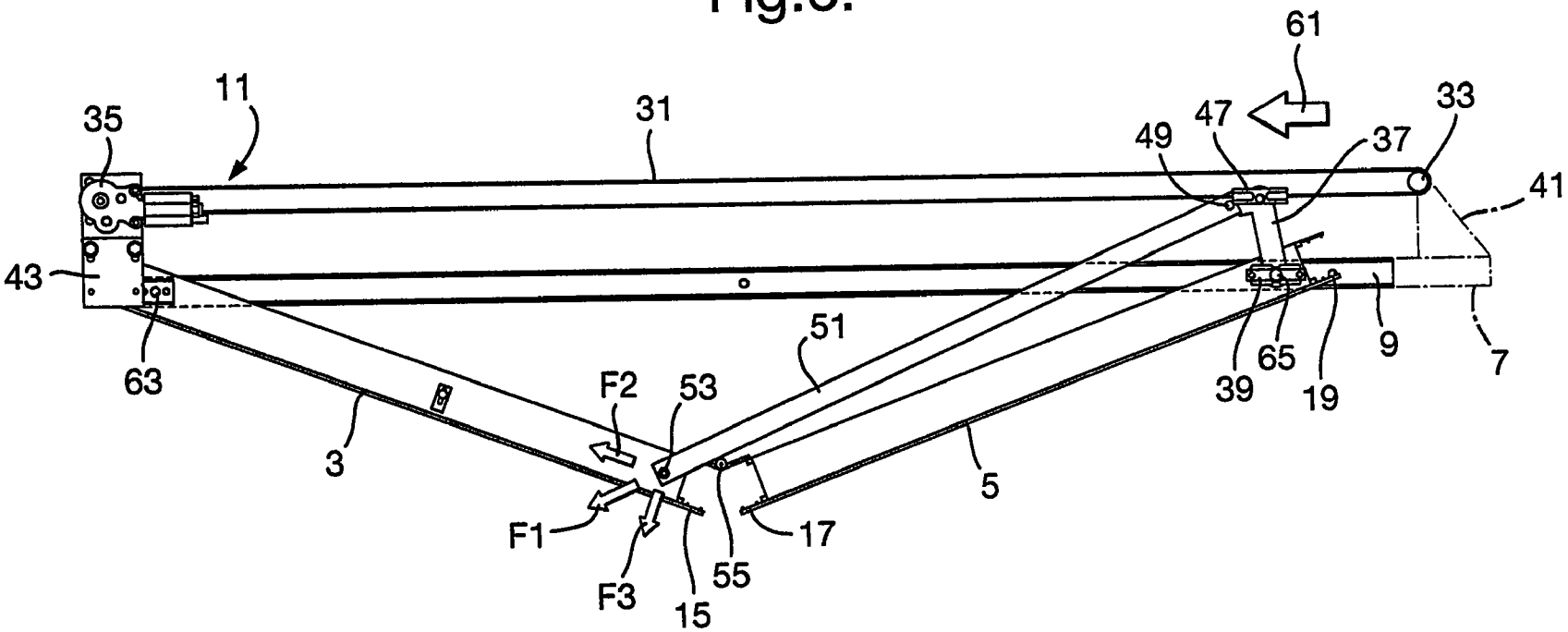
FIG. 6 shows a top plan view of the folding panel assembly in the position of FIG. 2.

As indicated in FIG. 6, movement of the carriage 37 in the direction of arrow 61 thus results in a longitudinal force F1 being transmitted by the connecting rod 51 on the second pivot 53 of the first panel 3. One component of the force F1, which is represented as force F2, acts in the direction of a first, fixed pivot 63 by which the first panel 3 is attached to the track 7. Perpendicular to force F2, a force component F3 initiates the opening of the hinge joint between the second and third vertical ends 15, 17 of the first and second panels 3, 5. The second panel 5 is pivotally connected by a second, movable pivot 65 to the shoe 39 for suspension from the carriage 37.

Figure 7:
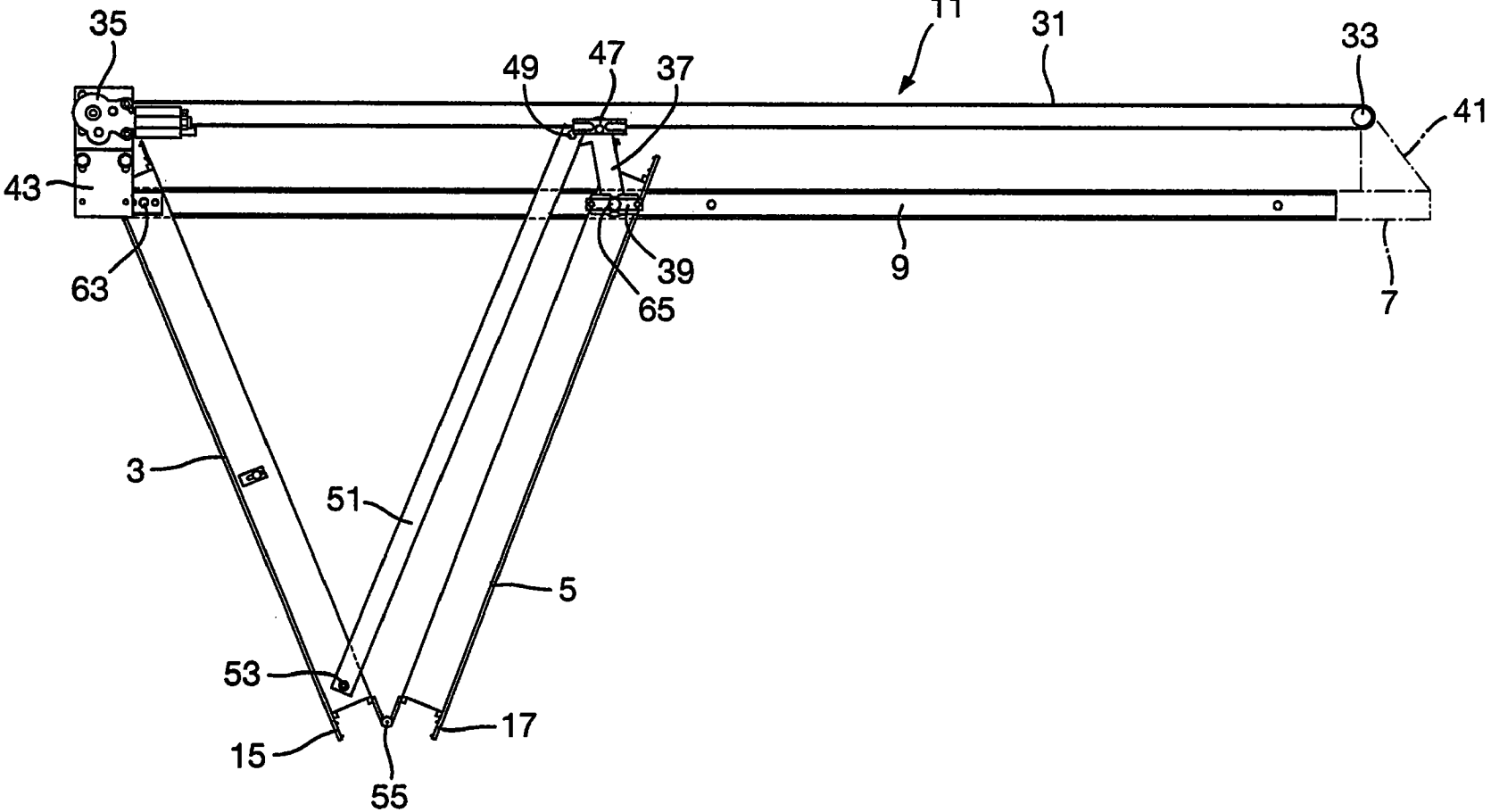
FIG. 7 shows a top plan view of the folding panel assembly in the position of FIG. 3.
Figure 8:
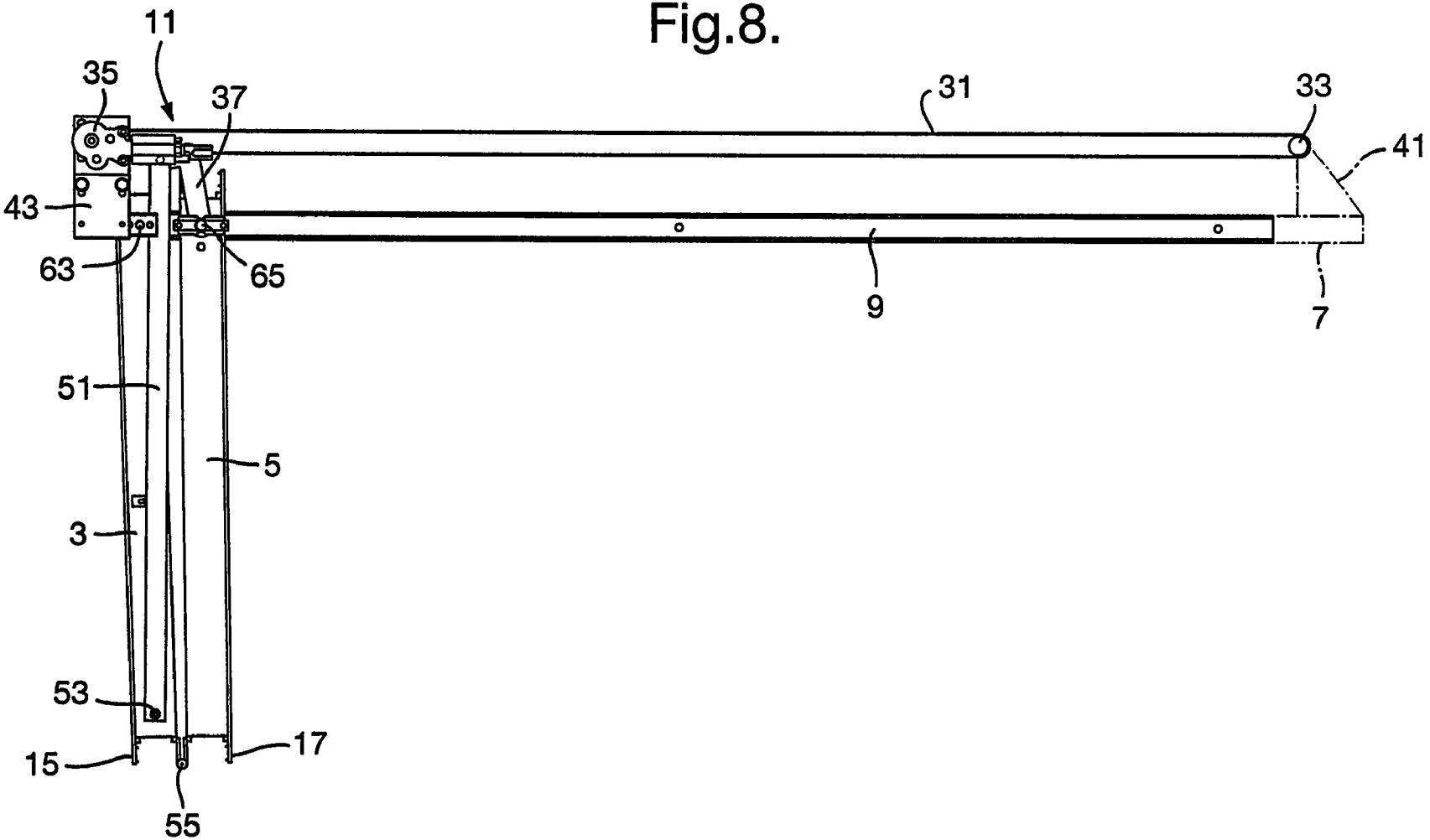
FIG. 8 shows a top plan view of the folding panel assembly in the position of FIG. 4.

FIGS. 7 and 8 show further opening stages of the folding panel assembly 1, wherein FIG. 8 represents the fully opened position. Comparing the relative position of the first panel 3 and the connecting rod 51 in FIGS. 5 and 8, it will be apparent that the connecting rod 51 will not in any position of its movement become aligned with the first panel 3.

The electric driving motor 35 is not shown in much detail, but the skilled person will appreciate that this can also include some kind of gear transmission and a further pulley wheel similar to pulley wheel 33 for drivingly engaging the flexible drive element or belt 31.

The first and second panels 3 and 5 are particularly suitable for execution in a form of framed louvers for the attachment to the outside of building structures. The louvre frame can then be defined by the vertical and upper and lower ends op the panels. Louvre panels may be retained there between in either a horizontal or a vertical orientation and each of the individual louvers may be pivotally adjustable for angular orientation. If so desired the folding panel assembly can also be executed as a bi-folding structure with third and fourth panels arranged symmetrically with respect to the first and second panels. There will then be an actuating system on each on each side, but it is also possible that a common flexible drive element is shared, whereby each side's carriage is engaged by an opposite one of the parallel branches of the flexible drive element. All such modifications or additions are considered to be within the capacity of the skilled person.

It is thus believed that the operation and construction of the present invention will be apparent from the foregoing description. The invention is not limited to any embodiment herein described and, within the purview of the skilled person; modifications are possible which should be considered within the scope of the appended claims. Equally all kinematic inversions are considered inherently disclosed and to be within the scope of the present invention. The term comprising when used in this description or the appended claims should not be construed in an exclusive or exhaustive sense but rather in an inclusive sense. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Features which are not specifically or explicitly described or claimed may be additionally included in the structure according to the present invention without deviating from its scope.

The invention claimed is:

1. A folding panel assembly including an actuating system, with the folding panel assembly including at least first and second, substantially rectangular panels, the first panel having first and second vertical ends, and the second panel having third and fourth vertical ends, the second and third vertical ends being hinged to one another about a hinge axis parallel thereto, the actuating system including:

a substantially horizontal track, having a substantially fixed first pivot support connected to the first panel;

a carriage traversable along the track, having a second pivot support connected to the second panel; and a flexible drive element arranged parallel to the track and in engagement with the carriage for traversing the carriage along the track, wherein an elongated connecting rod having a first longitudinal end pivotally connected to the carriage by a third pivot support and a second, opposite longitudinal end pivotally connected to the first panel at a location adjacent to the second vertical end thereof whereby said connecting rod moves said first panel when said carriage moves, and wherein a line through the first and second longitudinal ends of the elongated connecting rod is excluded from becoming aligned with respect to the first panel in any position of the carriage along the track, and the second pivot support and the third pivot support maintain a same relative position to each other along a length of the horizontal track.

2. Panel assembly according to claim 1, wherein the flexible drive element is looped around at least a first pulley wheel, located in a vicinity of a longitudinal end of the track.

3. Panel assembly according to claim 2, wherein one of the at least one pulley wheel and an optional further pulley wheel, is rotationally drivable for traversing the carriage.

4. Panel assembly according to claim 3, wherein the drivable pulley wheel is connected to an electric motor.

5. Panel assembly according to claim 1, wherein the carriage includes a shoe traversable along the track and where the second panel is operably connected to the shoe via the second pivot support.

6. Panel assembly according to claim 5, wherein the carriage further includes an engagement member engaged by the flexible drive element.

7. Panel assembly according to claim 6, wherein the carriage includes an extension arm connecting the shoe to the engagement member.

8. Panel assembly according to claim 6, wherein the engagement member carries the third pivot support receiving the first longitudinal end of the connecting rod.

9. Panel assembly according to claim 1, wherein the first and second panels are of equal width.

10. Panel assembly according to claim 1, wherein the track is in an overhead arrangement with respect to an upper end of the first and second panels and wherein the first and second panels are suspended from the track.

11. Panel assembly according to claim 10, further comprising a bottom rail for guiding the first and second panels at a lower end thereof.

12. Panel assembly according to claim 8 wherein said connecting rod is thereby operably and pivotally connected to said second panel at a spaced distance from said second panel.

13. Panel assembly according to claim 1 wherein said connecting rod is thereby operably and pivotally connected to said second panel at a spaced distance from said second panel.

* * * * *